United States Patent [19]

Greenwood

[11] 4,072,285

[45] Feb. 7, 1978

[54] DUMPABLE RAIN GUTTER SYSTEM

[76] Inventor: Edward L. Greenwood, 3721 S. Queensgrove Circle, Virginia Beach, Va. 23452

[21] Appl. No.: 719,401

[22] Filed: Sept. 1, 1976

[51] Int. Cl.[2] ..... E04D 13/06

[52] U.S. Cl. ..... 248/48.2; 52/11; 248/291; 248/292

[58] Field of Search ..... 248/48.1, 48.2, 284, 248/291, 292, 293; 52/11, 16, 12; 403/300, 356; 61/15

[56] References Cited

U.S. PATENT DOCUMENTS

| | | | |
|---|---|---|---|
| 288,307 | 11/1883 | Campbell | 248/291 X R |
| 304,425 | 9/1884 | Gould | 248/48.2 |
| 510,515 | 12/1893 | McKenney | 52/16 |
| 531,989 | 1/1895 | Andrews | 52/16 |
| 538,108 | 4/1895 | Freeze | 52/11 |
| 753,660 | 3/1904 | Boyer | 52/11 X |
| 953,506 | 3/1910 | Baum | 403/300 |
| 984,716 | 2/1911 | Swisher | 248/48.1 |
| 1,141,204 | 6/1915 | Noce | 52/11 |
| 1,414,345 | 5/1922 | Eeftink | 248/48.2 |
| 2,131,985 | 10/1938 | Strayer | 248/48.2 |
| 2,313,722 | 3/1943 | Brown | 403/356 X |
| 2,712,915 | 7/1955 | Cohen et al. | 248/48.2 |
| 3,007,662 | 11/1961 | Featheringham | 248/48.2 |
| 3,057,117 | 10/1962 | Singer | 248/48.1 X |
| 3,077,055 | 2/1963 | Tripp | 248/48.2 X |
| 3,091,055 | 5/1963 | Hegedusich | 248/48.2 X R |
| 3,333,803 | 8/1967 | Landis | 248/48.2 |
| 3,341,158 | 9/1967 | Landis | 248/48.2 |
| 3,630,473 | 12/1971 | Landis | 248/48.2 |
| 3,729,162 | 4/1973 | Salvato | 248/291 |
| 3,895,769 | 7/1975 | Hagaman | 248/48.2 |
| 3,915,418 | 10/1975 | D'Amato | 248/48.2 |

FOREIGN PATENT DOCUMENTS

| | | | |
|---|---|---|---|
| 578,461 | 6/1959 | Canada | 52/11 |

*Primary Examiner*—Roy D. Frazier
*Assistant Examiner*—Rodney H. Bonck
*Attorney, Agent, or Firm*—Charles P. Boukus, Jr.

[57] ABSTRACT

The invention permits a conventional rain gutter to be converted into a dumpable rain gutter system which can be easily cleaned. The system comprises a plurality of rain gutter supports, each including a mounting bracket adapted to be secured to the facia or trim board of a building and a gutter bracket adapted to be secured to a conventional rain gutter. A pivot connection is provided between the mounting bracket and the gutter bracket. A recoil spring normally retains the gutter upright, yet allows the gutter to pivot downward to be cleaned. Preferably, the system includes an elongated pivot rod rotatably supported by each mounting bracket and non-rotatably coupled to each gutter bracket to allow all gutter brackets to be operated simultaneously.

12 Claims, 6 Drawing Figures

DUMPABLE RAIN GUTTER SYSTEM

SPECIFICATION

The present invention relates to a dumpable rain gutter system and, more particularly, to a rain gutter system and support which allow a conventional rain gutter to be converted into a dumpable gutter system.

In conventional buildings, e.g. homes and apartments, a rain gutter or eaves trough is firmly mounted on a facia or trim board of the building to receive water runoff from its roof. The rain gutter or eaves trough is usually installed with brackets secured to the facia or trim board by spikes, screws, or other fasteners which are not intended to be removed. Consequently, to clean leaves, twigs, and other accumulated debris from the rain gutter or eaves trough, it is necessary to climb a ladder and manually remove the debris. Typically, the cleaning process is a tedious and somewhat dangerous operation which discourages frequent or regular cleaning of the rain gutter or eaves trough.

Although it has been proposed in the prior art to install rotatable or collapsible rain gutters on buildings, the prior art systems have been considerably complicated in structure. In addition, the prior art systems have required specially designed custom rain gutters to be used. As a result, the systems have been difficult and expensive to manufacture and install and have not experienced widespread use.

It is customary for conventional rain gutters to be fabricated of metal or plastic in standard trough configurations by economical extrusion or rolling techniques. Thus, to avoid the expense and difficulty of manufacture and installation of the prior art systems, it is essential for a dumpable rain gutter system to utilize conventional rain gutters rather than to require special or custom configurations. In addition, it is necessary for a dumpable rain gutter system to enhance the rigidity and strength of the rain gutter to operate satisfactorily under extreme weather conditions such as ice, snow, and high winds.

Accordingly, it is a primary objective of the present invention to provide a dumpable rain gutter system which incorporates conventional rain gutters. It is also an object of the invention to provide a dumpable rain gutter system which is uncomplicated in design and inexpensive to manufacture and install. Another object of the invention is to provide a dumpable rain gutter system which is enhanced in rigidity and easy to operate.

In addition, an object of the invention is to provide a rain gutter support which is particularly adaptable for use with a conventional rain gutter to allow the gutter to turn downward from its normal upright position to be cleaned. A further object is to provide a rain gutter support which is resiliently biased to normally maintain the gutter in an upright position.

The present invention is embodied as a dumpable rain gutter support for normally supporting a rain gutter upright and allowing the rain gutter to be turned downward to be cleaned. The support conveniently allows a conventional rain gutter to be converted into a dumpable rain gutter system.

In accordance with the invention, the dumpable rain gutter support comprises a mounting bracket adapted to be secured to the facia or trim board of a building, and a gutter bracket adapated to be secured to the gutter. The gutter bracket includes a vertical portion located behind the gutter and a horizontal ledge disposed beneath the gutter. The support also includes pivot means for connecting the mounting bracket and the gutter bracket to allow the gutter bracket to pivot relative to the mounting bracket, and resilient bias means for normally maintaining the gutter bracket upright and allowing the gutter bracket to pivot downward to permit the gutter to be cleaned. Preferably, the pivot means is located beneath the horizontal ledge of the gutter bracket to enhance the strength and rigidity of the dumpable rain gutter support.

In a preferred embodiment of the dumpable rain gutter support, the pivot means comprises a first pair of spaced vertical flanges on the mounting bracket, each flange being provided with an opening in horizontal alignment with the opening in the other flange, a second pair of spaced vertical flanges extending downward from the horizontal ledge of the gutter bracket, each flange being provided with an opening in horizontal alignment with the opening in the other flange, and a pivot rod received in the openings of the first and second flanges for pivotally connecting the mounting bracket and the gutter bracket together. In addition, the resilient bias means of the dumpable rain gutter support may be embodied as a recoil spring mounted on the pivot rod and having spring arms at opposite ends thereof for biasing the gutter bracket toward the mounting bracket to normally maintain the gutter upright. Further, in the preferred embodiment of the dumpable rain gutter support, the second pair of flanges of the gutter bracket is preferably spaced sufficiently apart to span the first pair of flanges of the mounting bracket.

The dumpable rain gutter support is preferably adapted to support a rain gutter in the form of a trough having a vertical rear wall, a horizontal bottom wall and a front wall. The mounting bracket is embodied as a flat plate to be secured to the facia or trim board and provided with a first pair of spaced vertical flanges extending perpendicularly forward from the plate. Each flange is provided with a circular opening in horizontal alignment with the circular opening of the other flange. The gutter bracket is embodied as a flat, L-shaped strip including a vertical portion for engaging the rear wall of the gutter and a horizontal ledge for supporting the bottom wall of the gutter. The second pair of spaced vertical flanges extend perpendicularly downward from the ledge. Each of the flanges is provided with a circular opening in horizontal alignment with the circular opening in the other flange. A pivot rod is received in the circular openings of the first and second flanges for pivotally connecting the mounting bracket and gutter bracket together. A recoil spring is mounted on the pivot rod and provided with spring arms at its opposite ends for biasing the gutter bracket toward the mounting bracket to normally maintain the gutter upright and to allow the gutter to pivot downward to be cleaned. The dumpable rain gutter support may also include a spreader pin received in openings provided in the front and rear walls of the gutter and secured to the vertical portion of the strip with a sleeve fitted over the spreader pin and located between the front and rear walls of the gutter to add rigidity to the gutter.

The invention is also embodied as a dumpable rain gutter system for normally supporting a rain gutter upright and allowing the rain gutter to turn downward to be cleaned. In accordance with the invention, the dumpable rain gutter system comprises a plurality of spaced gutter supports adapted to be secured to the facia or trim board of a building and to receive the rain gutter. Each support includes a mounting bracket to be secured to the facia or trim board and a gutter bracket comprising a vertical portion located behind the gutter and a horizontal ledge disposed beneath the gutter. Pivot means is provided for connecting the mounting bracket and the gutter bracket to allow the gutter bracket to pivot relative to the mounting bracket. Resilient bias means is provided for normally maintaining the gutter bracket upright and allowing the gutter bracket to pivot downward to permit the gutter to be cleaned. Preferably, the pivot means is located beneath the horizontal ledge of the gutter bracket.

In a preferred embodiment of the system, each mounting bracket includes a first pair of spaced vertical flanges extending perpendicularly forward from the mounting bracket, each flange having a circular opening in horizontal alignment with the circular opening in the other flange. Each gutter bracket includes a second pair of spaced vertical flanges extending perpendicularly downward from its horizontal ledge, each flange having a circular opening in horizontal alignment with the circular opening in the other flange. The pivot means includes an elongated pivot rod extending longitudinally along the gutter and received in the circular openings in the flanges of each mounting bracket and gutter bracket to pivotally connect the mounting brackets and gutter brackets together.

Preferably, each gutter bracket is non-rotatably secured to the elongated pivot rod to enhance the rigidity of the rain gutter and to overcome the resistance to torque along its length. At least one trip arm may be coupled to the pivot rod to allow the gutter brackets and gutter to be turned downward upon actuation of the trip arm.

The elongated pivot rod of the preferred embodiment may include a keyway and each gutter bracket may include a key to be received in the keyway to secure each gutter bracket to the pivot rod. The pivot rod may comprise a plurality of rod sections each including a keyway and a plurality of coupling collars provided with keys to be received in the keyways to join the rod sections together. The resilient bias means may be embodied as a recoil spring at each gutter support mounted on the pivot rod and having spring arms at its opposite ends for biasing the gutter bracket toward the mounting bracket to normally bias the gutter into an upright position.

The present invention achieves a dumpable rain gutter support which is particularly suitable for use with conventional rain gutters to provide a dumpable gutter system. The rain gutter support normally maintains the gutter in an upright position to receive water run-off and permits the gutter to turn downward to be cleaned. The support is uncomplicated in design and inexpensive to manufacture and install. In addition, the support provides enhanced rigidity to the gutter and yet ease in operation of the system.

The accompanying drawings illustrate preferred embodiments of the invention and, together with the description, serve to explain the principles of the invention.

Figure 1:
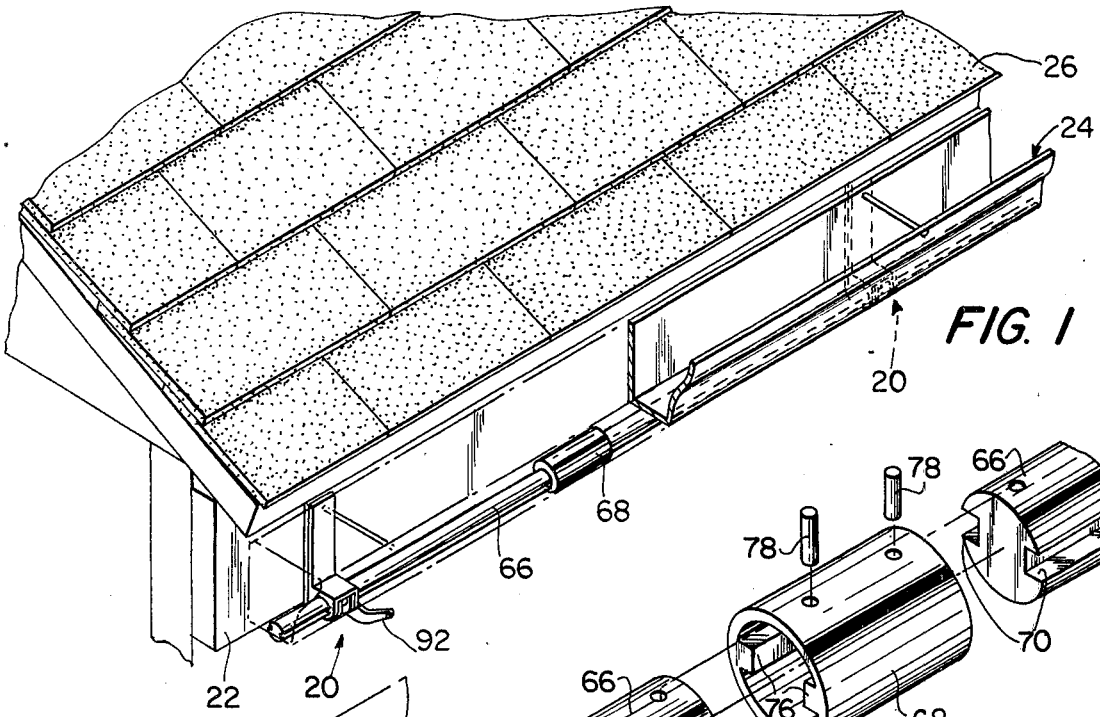
FIG. 1 is a partially cutaway, perspective view of a dumpable rain gutter system including a plurality of gutter supports constructed in accordance with the invention.

Referring to FIG. 1, a dumpable rain gutter system constructed in accordance with the present invention includes a plurality of spaced rain gutter supports, generally 20, mounted on a facia or trim board 22 of a building. A conventional rain gutter, generally 24, is mounted on supports 20 in a normally upright position to receive water run-off from a roof 26 of the building.

Figure 6:
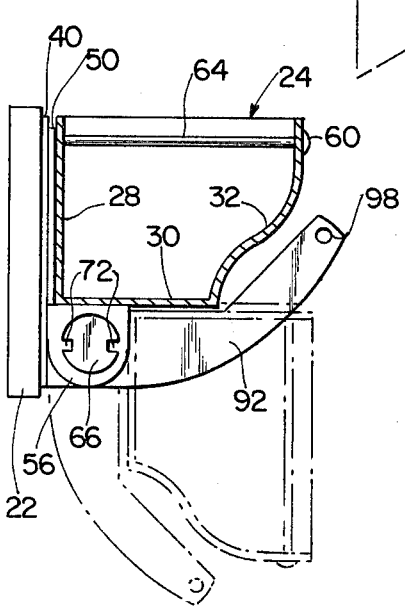
FIG. 6 is a side elevation view of the rain gutter support and rain gutter illustrating the normal upright position of the gutter and the downward position of the gutter to be cleaned.

As shown in FIG. 6, rain gutter 24 is in the form of a trough of conventional shape now in widespread use. The rain gutter includes a vertical rear wall 28, a horizontal bottom wall 30 and a front wall 32. The gutter may be formed of metal or plastic by conventional extrusion or rolling techniques.

Each rain gutter support comprises a mounting bracket 40 (FIGS. 2 and 4) adapted to be secured to facia or trim board 22. Mounting bracket 40 is embodied as a flat plate or strip provided with a plurality of holes 42 for receiving suitable fasteners, e.g., nails 43, to secure the mounting bracket to the facia or trim board in a vertical orientation. A pair of spaced vertical flanges 44 extend perpendicularly forward from the flat plate of the mounting bracket. Each flange is provided with a circular opening 46 in horizontal alignment with the circular opening in the other flange. If desired, nylon or plastic insert sleeves (not shown) which serve as bearings may be used in openings 46 of the flanges.

Figure 2:
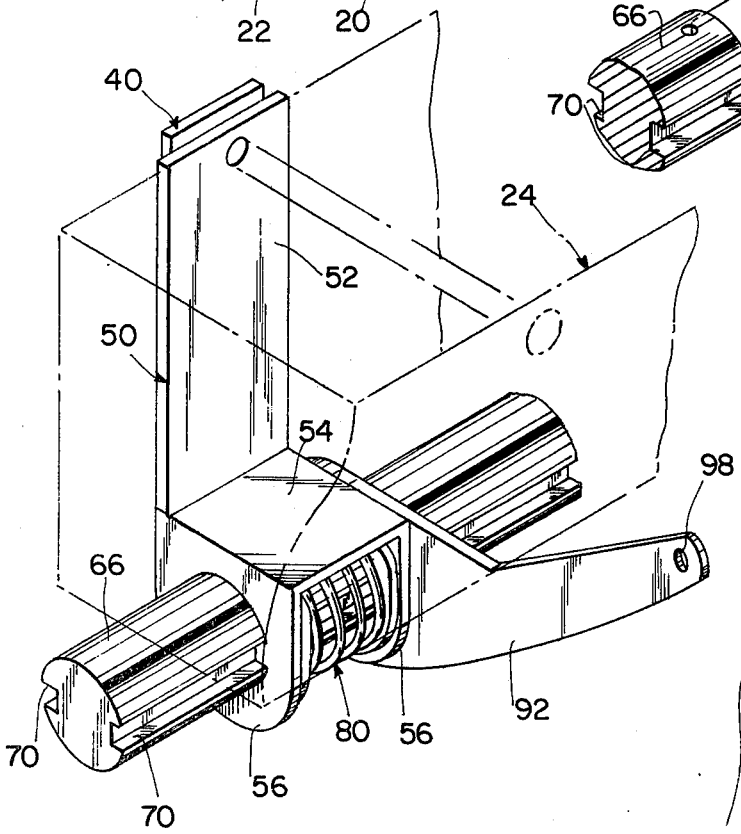
FIG. 2 is an enlarged perspective view of one of the rain gutter supports of FIG. 1.
Figure 3:
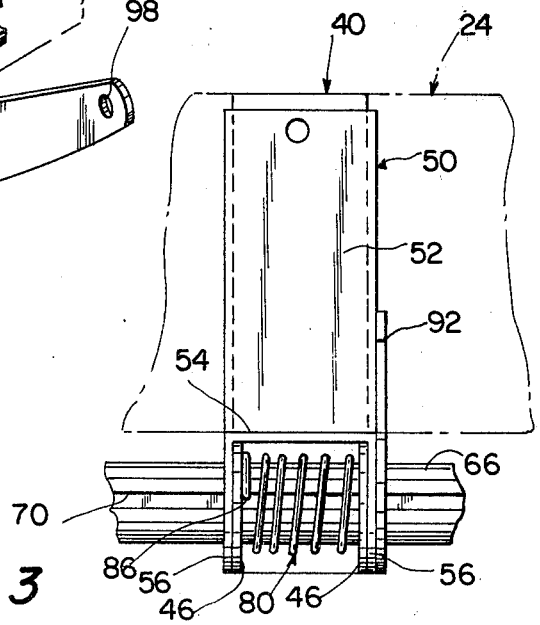
FIG. 3 is a front elevation view of the rain gutter support.

The rain gutter support also includes a gutter bracket 50 (FIGS. 2 and 4) adapted to be secured to rain gutter 24. Gutter bracket 50 is embodied as a flat, L-shaped strip including a vertical portion 52 for engaging rear wall 28 of gutter 24 and horizontal ledge 54 for supporting bottom wall 30 of the gutter. The L-shaped configuration of a gutter bracket 50 readily permits rain gutter support 20 to be used with rain gutter 24 (FIG. 6) of conventional shape. A pair of spaced vertical flanges 56 (FIGS. 2 and 4) extend perpendicularly downward from horizontal ledge 54. Each flange 56 is provided with a circular opening 58 in horizontal alignment with the circular opening in the other flange. Preferably, as shown in FIGS. 2 and 3, flanges 56 of gutter bracket 50 are spaced sufficiently apart to span flanges 44 of the mounting bracket upon assembly of the brackets.

Mounting bracket 40 and gutter bracket 50 of the rain gutter support can be easily fabricated from metal by conventional cutting, bending and stamping techniques. The gutter support can be conveniently employed with conventional gutters made of metal or plastic.

To secure rain gutter 24 to gutter supports 20, each support includes a spreader pin assembly comprising a spreader pin 60 received in suitable openings provided in the front and rear walls of the gutter. Spreader pin 60 has an enlarged head at its outer end to engage the front wall of the gutter and a threaded inner end to be received in a threaded opening 62 provided at the upper end of vertical portion 52 of the gutter bracket. The spreader pin assembly also includes a sleeve 64 fitted over spreader pin 60 and located between the front and rear walls of the gutter. Alternatively, opening 62 may be unthreaded and spreader pin 60 may be inserted into the unthreaded opening from the back side of vertical portion 52 of the gutter bracket, through the openings in the rear and front walls of the gutter, and may be secured with a conventional slip-on nut or other suitable fastener. The spreader pin and sleeve maintain the desired spacing between the front and rear walls of the rain gutter and add rigidity to the gutter.

In accordance with the invention, each rain gutter support includes pivot means for connecting the mounting bracket to the gutter bracket to allow the gutter bracket to pivot relative to the mounting bracket. Referring to FIG. 1, the pivot means is embodied as a pivot rod 66, preferably of metal, received in the circular openings provided in flanges 44 and 56 of mounting bracket 40 and gutter bracket 50, respectively. The location of pivot rod 66 beneath horizontal ledge 54 of mounting bracket 50 allows the weight of the gutter to be solidly supported by the pivot rod.

In the preferred embodiment of the system, pivot rod 66 is elongated and extends substantially along the length of rain gutter 24. Pivot rod 66 may comprise a single, continuous rod or a plurality of rod sections joined by suitable coupling collars 68 (FIG. 1) explained in more detail below.

Alternatively, each rain gutter support 20 may include only a short pivot rod received in the circular openings provided in flanges 44 and 56. In such an embodiment, each rain gutter support would include its own pivot rod in place of an elongated pivot rod extending along the length of the rain gutter.

Figure 5:
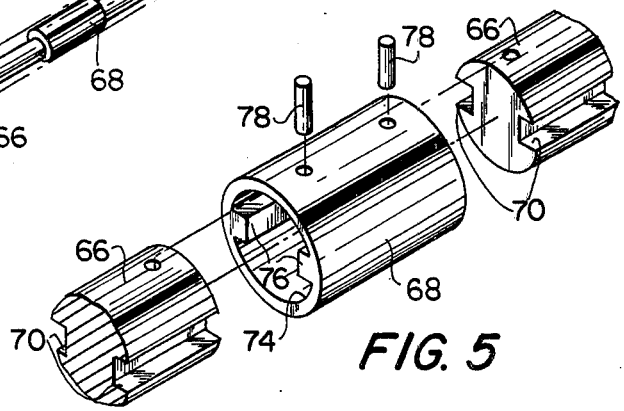
FIG. 5 is an exploded perspective view of adjacent sections of the pivot rod of the system illustrating a keyway and coupling collar arrangement employed to couple the rod sections together.
Figure 4:
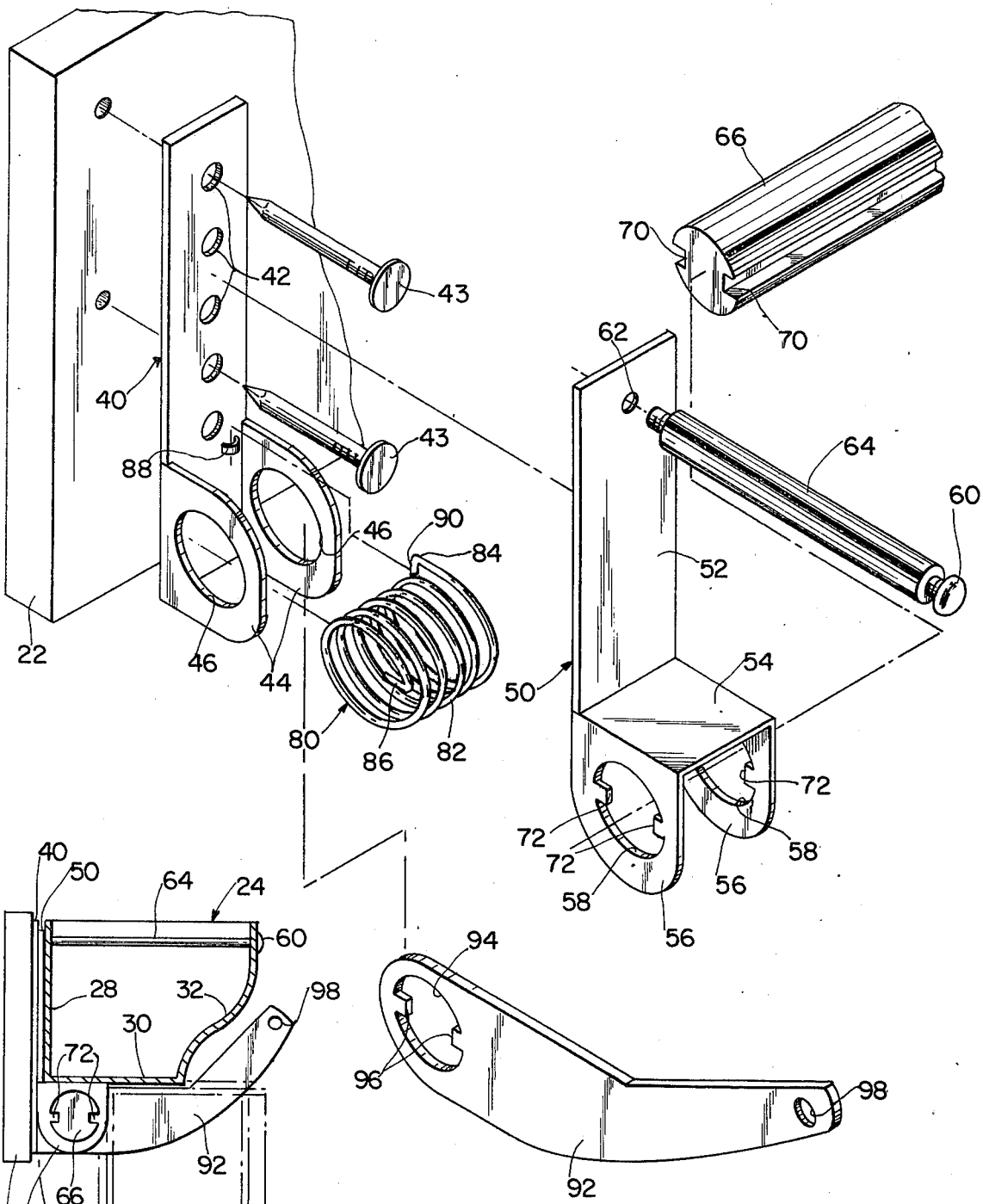
FIG. 4 is an exploded perspective view illustrating a mounting bracket, gutter bracket, pivot rod, recoil spring, spreader pin assembly and trip arm of the rain gutter support.

In the preferred embodiment, each gutter bracket is non-rotatably secured to the pivot rod. As shown in FIGS. 4 and 5, pivot rod 66 is preferably circular in cross-section and provided with one or more keyways extending longitudinally along the outer surface of the pivot rod. For example, a pair of keyways 70 may be located at diametrically opposed positions on the surface of pivot rod 66. However, it is understood that other keyway arrangements, e.g., a single keyway, may be used within the scope of the invention.

Referring to FIG. 4, each flange 56 of gutter bracket 50 includes a pair of projections 72 extending into circular opening 58 at diametrically opposed positions. Projections 72 serve as keys which are received in keyways 70 of pivot rod 66 to provide a non-rotatable connection between gutter bracket 50 and pivot rod 66. This connection allows all of the gutter brackets to turn simultaneously upon rotation of pivot rod 66. Alternatively, other key arrangements, e.g., a single projection in each circular opening 58, can be used within the scope of the present invention.

As explained above, pivot rod 66 may be embodied as a plurality of separate rod sections joined by coupling collars 68. Referring to FIG. 5, each rod section may include a pair of keyways 70 located at diametrically opposed positions on the outer surface of the pivot rod. Coupling collar 68 includes a circular opening 74 extending therethrough for receiving adjacent pivot rod sections. A pair of projections 76 extend radially inward from the interior of collar 68 and are received in keyways 70 of the adjacent rod sections to join the rod sections together. Any conventional arrangement can be used to secure collar 68 to the rod sections to prevent longitudinal separation of the collar from the rod sections. For example, a set of drift pins 78 of soft metal may be received in suitable holes drilled in coupling collar 68 and the rod sections. Other arrangements such as screws, bolts, or lock rings may also be used. Coupling collar 68 provides a non-rotatable connection between adjacent pivot rod sections.

In accordance with the invention, each rain gutter support includes resilient bias means for normally maintaining the gutter bracket upright and allowing the gutter bracket to pivot downward to permit the gutter to be cleaned. Referring to FIGS. 3 and 4, the resilient bias means is embodied as a recoil spring 80 having a coil portion 82 mounted on pivot rod 66 and a pair of spring arms 84 and 86 at opposite ends of the coil portion for biasing gutter bracket 50 toward mounting bracket 40 to maintain the rain gutter support upright. The purpose of recoil spring 80 is to bias gutter bracket 50 into a normally vertical position in which rain gutter 24 receives water run-off from the roof and to allow gutter bracket 50 to pivot downward to be cleaned.

As shown in FIG. 4, a flange 88 is provided on the front surface of mounting bracket 40. The end of spring arm 84 of the recoil spring is bent to form a vertical finger 90 for engaging flange 88 to secure the spring arm to mounting bracket 40. In addition, as shown in FIGS. 3 and 4, spring arm 86 is normally oriented horizontally to extend into keyway 70 at the front of pivot rod 66. Each spring 80 normally exerts a return bias force via its spring arms. As a result, gutter bracket 50, which is non-rotatably coupled to pivot rod 66 via projections 72, is normally biased toward mounting bracket 50 to maintain gutter 24 in an upright position (FIG. 6). Alternatively, spring arm 86 may be coupled directly to gutter bracket 50, e.g., by an appropriate flange (not shown), to maintain the gutter upright.

In a preferred embodiment of the system, at least one trip arm is coupled to the pivot rod to allow the gutter brackets and gutter to be turned downward upon actuation of the trip arm. As shown in FIG. 4, a trip arm 92 is provided with a circular opening 94 at one end thereof for receiving pivot rod 66. A pair of projections 96 extend into circular openings 94 at diametrically opposed positions to serve as keys to be received in keyways 70 of the pivot rod. Trip arm 92 extends outward and upward and its outer end includes a hole 98 for engagement by a suitable actuating device. For example, a pull cord (not shown) may be attached to trip arm 80 through hole 86 to allow an operator on the ground to actuate the trip arm.

When trip arm 92 is pulled downward, pivot rod 66 and gutter brackets 50 pivot as a unit in a clockwise direction against the bias of recoil springs 80 to turn gutter 24 downward, as shown in phantom lines in FIG. 6, to be cleaned. Each recoil spring is thus tightened to increase its normal bias force. After gutter 24 is cleaned, trip arm 92 is released to allow the pivot rod, gutter brackets and gutter to return to the normal upright position under the action of the recoil springs.

It is understood that other arrangements can be used in place of the keys and keyways of the preferred embodiment to provide the desired non-rotatable connection between the pivot rod, gutter brackets, and trip arm. For example, a pivot rod having a square cross-section may be used with square openings in flanges 56 of the gutter bracket and the trip arm to receive the square pivot rod. The openings in flanges 44 mounting bracket 40 would remain circular to allow the pivot rod and gutter bracket to pivot relative to the mounting bracket. Further alternative connections can be achieved without departing from the scope of the present invention.

Preferably, the rain gutter supports 20 and pivot rod 66 of the system may be pre-assembled to insure proper alignment of the gutter supports upon installation of the system on facia or trim board 22. The system can be simply installed by using conventional fasteners, e.g., nails or screws, to secure mounting brackets 40 to the facia or trim board. Spring arms 84 and 86 of recoil springs 80 can be initially disengaged from mounting brackets 40 and pivot rod 66 to facilitate fastening of the mounting brackets to the facia or trim board. After mounting brackets 40 are securely fastened, the spring arms can be moved into engagement with flanges 88 of the mounting brackets and keyway 70 of the pivot rod. Then, rain gutter 24 can be placed on horizontal ledges 54 of gutter brackets 50 and secured to vertical portions 52 of the gutter brackets by the spreader pin assemblies. Subsequent replacement of the rain gutter is easily accomplished by removal of the spreader pin assemblies and installation of a new rain gutter.

Further, it is contemplated that a detachable or flexible coupling arrangement will be provided between the rain gutter and the downspouts of the system to allow the rain gutter to pivot downward without interference from the downspouts. For example, a suitable coupling arrangement (not shown) which allows each downspout to move downward and pivot away from the rain gutter can be employed.

The invention in its broader aspects is not limited to the specific details shown and described, and modifications may be made in the dumpable rain gutter system and support without departing from the principles of the invention.

What is claimed is:

1. A dumpable rain gutter support for normally supporting a rain gutter of the type having a vertical rear wall, a horizontal bottom wall and a front wall in an upright position and allowing the rain gutter to turn downward to be cleaned, comprising:

a mounting bracket adapted to be secured to the facia or trim board of a building;

a gutter bracket adapted to be secured to the gutter, said gutter bracket including a vertical portion located behind and secured to the rear wall of the gutter and a horizontal ledge disposed beneath the gutter to support the bottom wall thereof;

a first pair of spaced vertical flanges on said mounting bracket, each flange being provided with an opening in horizontal alignment with the opening in the other flange;

a second pair of spaced vertical flanges extending downward from said horizontal ledge of said gutter bracket, each flange being provided with an opening in horizontal alignment with the opening in the other flange;

a pivot rod received in the openings of said first and second flanges for pivotally connecting said mounting bracket and said gutter bracket together; and resilient bias means for normally maintaining said gutter bracket upright and allowing said gutter bracket to pivot downward to permit the gutter to be cleaned.

2. The dumpable rain gutter support of claim 1, wherein:

said second pair of flanges of said gutter bracket is spaced apart to span said first pair of flanges of said mounting bracket.

3. A dumpable rain gutter support for supporting a rain gutter in the form of a trough having a vertical rear wall, a horizontal bottom wall and a front wall to normally maintain the gutter upright and to allow the gutter to turn downward to be cleaned, said support comprising:

a mounting bracket adapted to be mounted on the facia or trim board of a building, said mounting bracket comprising a flat plate to be secured to the facia or trim board and provided with a first pair of spaced vertical flanges extending perpendicularly forward from said plate, each flange being provided with a circular opening in horizontal alignment with the circular opening in the other flange;

a gutter bracket adapted to be secured to the gutter, said gutter bracket comprising a flat, L-shaped strip including a vertical portion for engaging the rear wall of the gutter and a horizontal ledge for supporting the bottom wall of the gutter, said horizontal ledge having a second pair of spaced vertical flanges extending perpendicularly downward therefrom, each of said flanges being provided with a circular opening in horizontal alignment with the circular opening in the other flange;

means for securing the rear wall of the gutter to said vertical portion of said L-shaped strip;

a pivot rod received in the circular openings of said first and second flanges for pivotally connecting said mounting bracket and said gutter bracket together; and a recoil spring mounted on said pivot rod and provided with spring arms at opposite ends thereof for biasing said gutter bracket toward said mounting bracket to normally maintain the gutter upright and to allow the gutter to pivot downward to be cleaned.

4. The dumpable rain gutter support of claim 3, wherein said securing means comprises:

a spreader pin received in openings provided in the front and rear walls of the gutter and secured to said vertical portion of said strip and a sleeve fitted over said spreader pin and located between the front and rear walls of the gutter to add rigidity to the gutter.

5. A dumpable rain gutter support for normally supporting a rain gutter of the type having a vertical rear wall, a horizontal bottom wall and a front wall in an upright position and allowing the rain gutter to turn downward to be cleaned, comprising:

a mounting bracket adapted to be secured to the facia or trim board of a building;

a gutter bracket adapted to be secured to the gutter, said gutter bracket including a vertical portion located behind and secured to the rear wall of the gutter and a horizontal ledge disposed beneath the gutter to support the bottom wall thereof;

said mounting bracket including at least one vertical flange and said gutter bracket including at least one vertical flange extending downward from said horizontal ledge, each flange being provided with an opening in horizontal alignment with the opening in the other flange;

a pivot rod received in the openings of said first and second flanges for pivotally connecting said mounting bracket and said gutter bracket together; and a recoil spring mounted on said pivot rod and having spring arms at opposite ends thereof for biasing said gutter bracket toward said mounting bracket to normally maintain the gutter upright.

6. A dumpable rain gutter system for normally supporting a rain gutter of the type having a vertical rear wall, a horizontal bottom wall and a front wall in an upright position and allowing the rain gutter to turn downward to be cleaned, comprising:

a plurality of spaced gutter supports adapted to be secured to the facia or trim board of a building and to receive the rain gutter, each support including a mounting bracket adapted to be secured to the facia or trim board and a gutter bracket comprising a vertical portion located behind and secured to the rear wall of the gutter and horizontal ledge disposal beneath the gutter to support the bottom wall thereof;

each mounting bracket including a first pair of spaced vertical flanges extending perpendicularly forward from said mounting bracket, each flange having a circular opening in horizontal alignment with the circular opening in the other flange;

each gutter bracket including a second pair of spaced vertical flanges extending perpendicularly downward from said horizontal ledge, each flange having a circular opening in horizontal alignment with the circular opening in the other flange;

an elongated pivot rod extending longitudinally along the gutter and received in said circular openings in said flanges of each mounting bracket and each gutter bracket to pivotally connect said mounting brackets and gutter brackets together; and resilient bias means for normally maintaining said gutter bracket and rain gutter in an upright position and allowing said gutter bracket to pivot downward from its upright position to permit the rain gutter to be cleaned.

7. The dumpable rain gutter system of claim 6, wherein:

each gutter bracket is non-rotatably secured to said elongated pivot rod.

8. The dumpable rain gutter system of claim 7, which includes:

at least one trip arm coupled to said pivot rod to allow the gutter brackets and gutter to be turned downward upon actuation of said trip arm.

9. The dumpable rain gutter system of claim 6, wherein:

said elongated pivot rod includes a keyway; and each gutter bracket includes a key to be received in said keyway to non-rotatably secure each gutter bracket to said pivot rod.

10. The dumpable rain gutter system of claim 9, wherein:

said pivot rod comprises a plurality of rod sections each including a keyway and a plurality of coupling collars provided with keys to be received in said keyways to non-rotatably couple said rod sections together.

11. The dumpable rain gutter system of claim 9, which includes:

at least one trip arm provided with a circular opening to receive said pivot rod and a key to be received in said keyway of said pivot rod.

12. The dumpable rain gutter system of claim 6, wherein said resilient bias means comprises:

a recoil spring at each gutter support mounted on said pivot rod and having spring arms at opposite ends thereof for biasing said gutter bracket toward said mounting bracket to normally bias the gutter into its upright position.

* * * * *